US007684978B2

(12) United States Patent
Sung et al.

(10) Patent No.: US 7,684,978 B2
(45) **Date of Patent: *Mar. 23, 2010**

(54) APPARATUS AND METHOD FOR TRANSCODING BETWEEN CELP TYPE CODECS HAVING DIFFERENT BANDWIDTHS

(75) Inventors: Jongmo Sung, Daejon (KR); Sang Taick Park, Seoul (KR); Do Young Kim, Daejon (KR); Bong Tae Kim, Daejon (KR)

(73) Assignee: Electronics and Telecommunications Research Institute (KR)

( * ) Notice: Subject to any disclaimer, the term of this patent is extended or adjusted under 35 U.S.C. 154(b) by 1144 days.

This patent is subject to a terminal disclaimer.

(21) Appl. No.: 10/697,909

(22) Filed: Oct. 30, 2003

(65) Prior Publication Data

US 2004/0102966 A1 May 27, 2004

(30) Foreign Application Priority Data

Nov. 25, 2002 (KR) ..... 10-2002-0073409

(51) Int. Cl.

| | |
|---|---|
| ***G10L 19/12*** | (2006.01) |
| ***G10L 19/14*** | (2006.01) |
| ***G10L 19/06*** | (2006.01) |
| *G10L 19/00* | (2006.01) |
| *G10L 13/00* | (2006.01) |

(52) U.S. Cl. ..... 704/223; 704/219; 704/221; 704/209; 704/262; 704/265

(58) Field of Classification Search ..... 704/201–209, 704/219, 221–223, 258–270

See application file for complete search history.

(56) References Cited

U.S. PATENT DOCUMENTS 5,351,338 A * 9/1994 Wigren ..... 704/219
5,371,853 A * 12/1994 Kao et al. ..... 704/200.1
6,172,974 B1 1/2001 Tseng et al.

(Continued)

FOREIGN PATENT DOCUMENTS

KR 2001-0102004 11/2001

OTHER PUBLICATIONS

"A Bitrate and Bandwidth Scalable CEP Coder", Nomura et al., 1998 IEEE, pp. 341-344.*

(Continued)

*Primary Examiner*—David R Hudspeth
*Assistant Examiner*—David Kovacek
(74) *Attorney, Agent, or Firm*—Blakely, Sokoloff, Taylor & Zafman

(57) ABSTRACT

The present invention overcomes problems of tandem coding method such as degradation of speech quality, increased system latency and computations. An apparatus for trans-coding between code excited linear prediction (CELP) type codecs with different bandwidths, includes: a format parameter translating unit for generating output formant parameters by translating formant parameters from input CELP format to output CELP format; a formant parameter quantizing unit for receiving the output format formant parameters and quantizing the output format formant filter coefficients; an excited parameter translating unit for generating output excitation parameters by translating excitation parameters from input CELP format to output CELP format; and an excitation quantizing unit for receiving the output format excitation parameters and quantizing the output format excitation parameters.

7 Claims, 8 Drawing Sheets

U.S. PATENT DOCUMENTS

| | | | | |
|---|---|---|---|---|
| 6,208,958 | B1 * | 3/2001 | Cho et al. | 704/207 |
| 6,260,009 | B1 | 7/2001 | Dejaco | |
| 6,308,222 | B1 * | 10/2001 | Krueger et al. | 709/247 |
| 6,615,174 | B1 * | 9/2003 | Arslan et al. | 704/270 |
| 6,757,649 | B1 * | 6/2004 | Gao et al. | 704/222 |
| 6,829,579 | B2 * | 12/2004 | Jabri et al. | 704/221 |
| 6,871,176 | B2 * | 3/2005 | Choi et al. | 704/223 |
| 6,950,463 | B2 * | 9/2005 | Moni et al. | 375/240.03 |
| 2003/0028643 | A1 * | 2/2003 | Jabri | 709/226 |
| 2004/0024591 | A1 * | 2/2004 | Boillot et al. | 704/209 |
| 2004/0172402 | A1 * | 9/2004 | Jabri et al. | 707/100 |

OTHER PUBLICATIONS

"SNR And Bandwidth Scalable Speech Coding", Dong et al., 2002 IEEE, pp. 859-862.*

"An Efficient Transcoding Algorithm For G.723.1 and EvRC Speech Coders", K. Kim, et al., 2001 IEEE, pp. 1561-1564.

"Improving Transcoding Capability of Speech Coders in Clean and Frame Erasured Channel Environments", H. Kang, et al., 2000 IEEE, pp. 78-80.

Ota, et al. "Speech Coding Translation for IP and 3G Mobile Integrated Network," IEEE 2002, pp. 114-118.

* cited by examiner

PRIOR ART

APPARATUS AND METHOD FOR TRANSCODING BETWEEN CELP TYPE CODECS HAVING DIFFERENT BANDWIDTHS

FIELD OF THE INVENTION

The present invention relates to speech coding techniques, and more particularly, to an apparatus and method for trans-coding between code excited linear prediction (CELP) type codecs having different bandwidths.

DESCRIPTION OF THE PRIOR ART

A technology for transmitting speech in digital has become widespread in a wired communication such as a telephone network, wireless communication and voice over Internet (VoIP) network.

If speech is transmitted by simply sampling and digitizing and encoding in an A-law or u-law PCM (Pulse-Coded Modulation), a data rate of 64 kilobits per second (kbps) is required. However, the data rate for transmitting speech can be reduced by using speech analysis and appropriate coding method.

A vocoder is a device for compressing speech by extracting crucial parameters based on a human speech production model.

The vocoder includes an encoder and a decoder. The encoder analyzes the incoming speech so as to extract the relevant parameters. The decoder re-synthesizes the speech using the parameters received over a channel, such as a transmission channel.

A linear-prediction-based time domain vocoder is the most popular type of the vocoder. The linear-prediction-based technique extracts the correlation between the input speech samples and past samples, and encodes only the uncorrelated part.

The function of the vocoder is to compress the digitized speech signal into a bit stream in a low rate by removing all of the natural redundancies inherent in the speech. The speech typically has short term redundancies due primarily to the filtering operation of the lips and tongue, and long term redundancies due to the vibration of the vocal cords. In a code excited linear prediction (CELP) coder, two filters, a short-term formant filter and a long-term pitch filter are used for modeling the speech. Once these redundancies are removed, the resulting residual signal is modeled as white noise or multi-pulse according to a kind of CELP coding.

The basis of this technique is to compute the parameters of two digital filters, a formant filter and a pitch filter. The formant filter is a linear predictive coding (LPC) filter and performs short-term prediction of the speech signal. The pitch filter performs long-term prediction of the speech signal. Thus the information transmitted through a channel are (1) the LPC filter coefficients, (2) the delays and gains of pitch filter and (3) the codebook excitation parameters.

Digital speech coding can be divided into two parts; encoding and decoding. FIG. 1 is a block diagram showing a speech transmission system through the channel using the typical digital speech coding.

Referring to FIG. 1, a system includes an encoder 12, a decoder 16 and a channel 14. The channel 14 can be a communications channel or a storage medium.

The encoder 12 receives digitized input speech, extracts parameters describing features of the input speech, and quantizes these parameters into an encoded bit stream. The encoded bit stream is sent to the channel 14. The decoder 16 receives the transmitted bit stream from the channel 14 and reconstructs an output speech signal from the received bit stream.

Many different types of CELP coding are in use today. In order to successfully decode a CELP-coded speech signal, the decoder 16 must employ the same CELP coding model (also referred to as "format") as the encoder 12.

The speech signal needs to be converted from one CELP coding format to another so as to successfully communicate among networks or systems employing different CELP codecs.

Most speech coding systems in use today are based on telephone-bandwidth narrowband speech, nominally limited to about 200-3400 Hz and sampled at a rate of 8 kHz. The inherent bandwidth limitations cause degradation to the communication quality. Recently, there are various efforts to develop wideband speech (band-limited to about 20~7000 Hz) coding systems surpassing the quality of conventional telephone-bandwidth speech. The 3$^{rd}$ Generation Partnership Project (3GPP) and the International Telecommunication Union-Telecommunication (ITU-T) have recognized the importance of wideband speech and had selected the Adaptive Multi Rate-WideBand (AMR-WB), a.k.a. and ITU-T G.722.2 as their wideband speech codec standard. And also the 3$^{rd}$ Generation Partnership Project 2 (3GPP2) goes through with its own wideband speech codec standard. Thus narrowband speech network and wideband speech codec standard. Thus narrowband speech networks and wideband speech networks may co-exist in the near future. When networks employing the different codec standard are inter-networking through the gateway system, there is a need for translation of the coded bit stream. Generally, when we inter-link the networks employing the different codecs with the different bandwidths, we need more sophisticated translation skill. This translation operation is so called (trans-coding." The conventional and simple solution is that an encoder part of one codec is concatenated to a decoder part of the other codec.

FIG. 2 is a block diagram showing a conventional tandem coding system for translating from one CELP codec to the other CELP codec with its own different bandwidths.

The tandem coding system includes a decoder 22, a speech bandwidth converter 24 and an encoder 26. The decoder 22 receives an input bit stream that has been encoded based upon an input CELP format, decodes the input bit stream and produces a speech signal. The speech bandwidth converter 24 converts from a sampling frequency of input CELP format to that of output CELP format. This procedure can be done using the conventional sampling rate conversion such as decimation or interpolation operation. The encoder 26 receives the decoded and sampling rate converted speech signal and encodes the speech signal in the output format. The primary disadvantage of tandem coding is the speech quality degradation experienced by the speech signal while the speech signal is passing through multiple encoders and decoders. Also, the tandem coding method suffered from the more system latency and the higher computational load.

SUMMARY OF THE INVENTION

It is, therefore, an object of the present invention to provide an apparatus and method for trans-coding between code excited linear prediction (CELP) type codecs having different bandwidths in order to overcome the disadvantage of conventional tandem coding method such as degradation of speech quality and increased system latency and computations.

In accordance with one aspect of the present invention, there is provided an apparatus for trans-coding between code excited linear prediction (CELP) type codecs having different bandwidths including: a formant parameter translating unit for translating formant parameters from input CELP format to output CELP format and generating formant parameters in an output CELP format; a formant parameter quantizing unit for receiving the translated formant parameters and quantizing the translated formant parameters; an excitation parameter translating unit for translating excitation parameters from input CELP format to output CELP format and generating excitation parameters in an output CELP format; and an excitation quantizing unit for receiving the translated excitation parameters and quantizing the translated excitation parameters.

In accordance with another aspect of the present invention, there is provided a method for trans-coding between CELP type codecs having different bandwidths, including the steps of: a) translating formant parameters from input CELP format to output CELP format and generating formant parameters in an output CELP format; b) receiving the translated formant parameters and quantizing the translated formant parameters; c) translating excitation parameters from input CELP format to output CELP format and generating excitation parameters in an output CELP format; and d) receiving the translated excitation parameters and quantizing the translated excitation parameters.

In accordance with still another aspect of the present invention, there is provided a computer readable recording medium for executing a method for trans-coding between CELP type codecs having different bandwidths, including the instructions of: a) translating formant parameters from input CELP format to output CELP format and generating formant parameters in an output CELP format; b) receiving the translated formant parameters and quantizing the translated formant parameters; c) translating excitation parameters from input CELP format to output CELP format and generating excitation parameters in an output CELP format; and d) receiving the translated excitation parameters and quantizing the translated excitation parameters.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Other objects and aspects of the invention will become apparent from the following description of the embodiments with reference to the accompanying drawings, which is set forth hereinafter.

Figure 1:
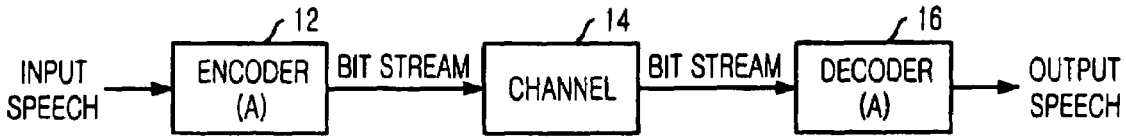
FIG. 1 is a block diagram showing a speech transmission system through a channel using typical digital speech coding.
Figure 2:
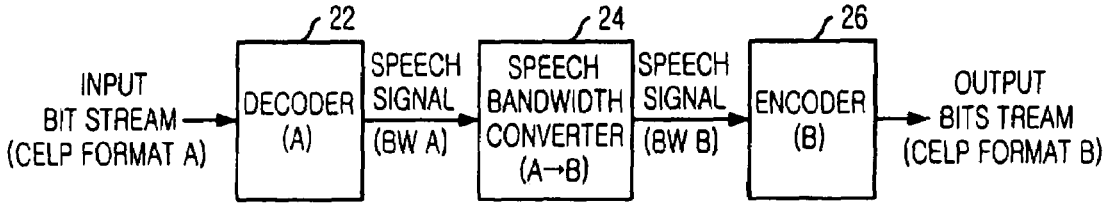
PRIOR ART FIG. 2
FIG. 2 is a block diagram illustrating a tandem coding system for translating from one CELP codec to the other CELP codec with its own different bandwidths.
Figure 3:
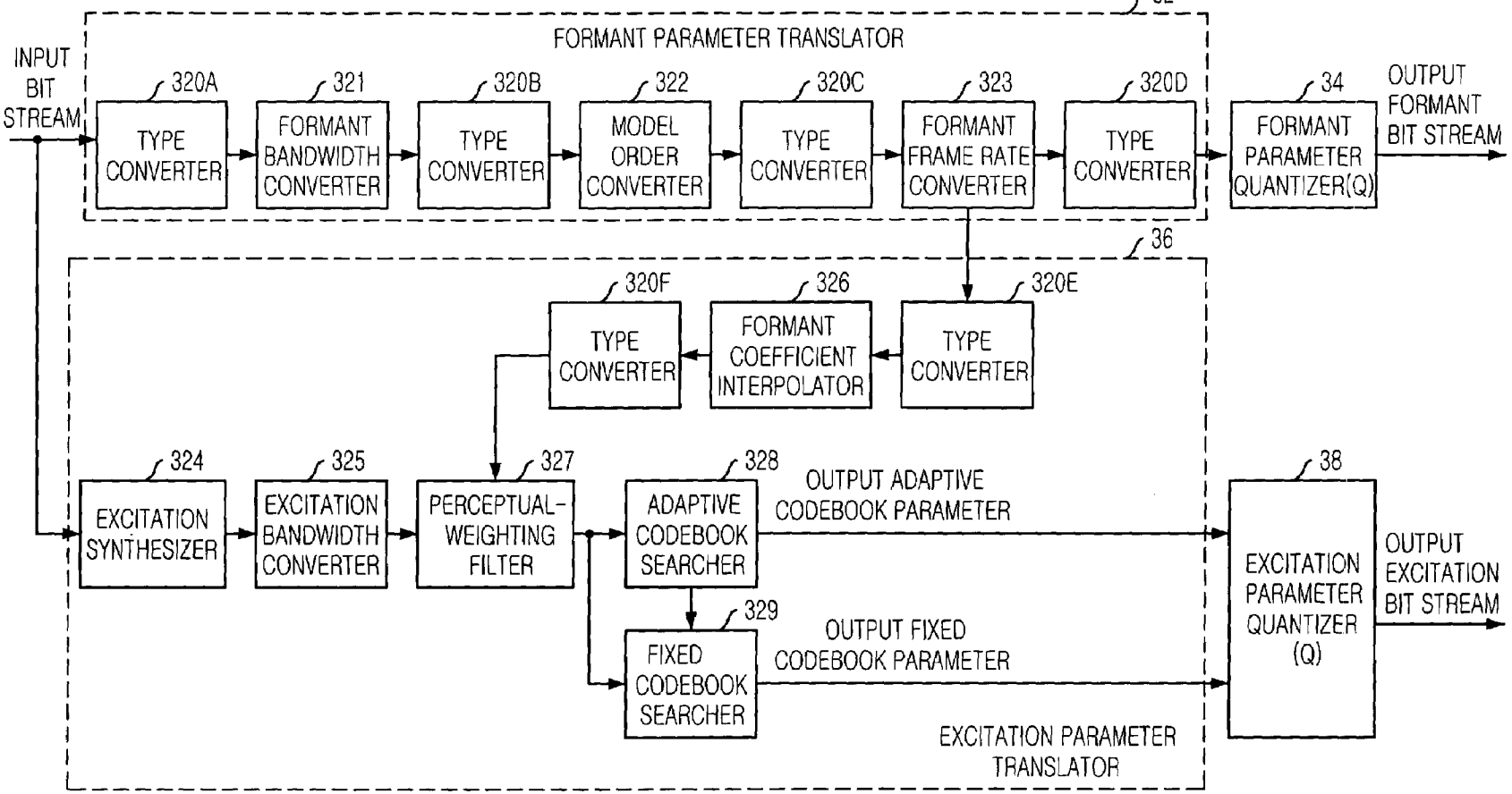
FIG. 3 is a block diagram depicting an apparatus for trans-coding between CELP codecs having different bandwidths in accordance with the present invention.
Figure 4:
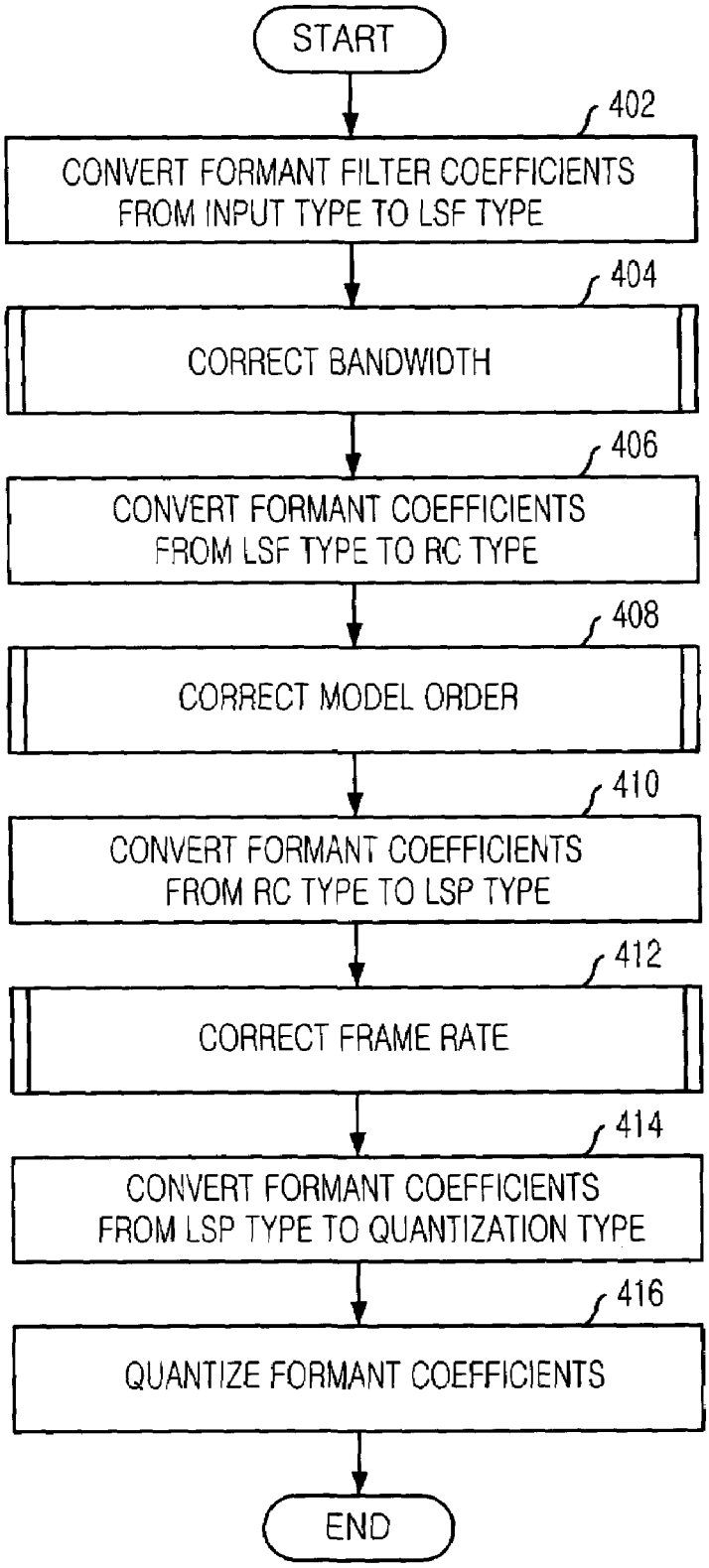
FIGS. 4 to 7 are flowcharts explaining operating procedures of a formant parameter translator in accordance with the present invention.

FIG. 3 is a block diagram depicting an apparatus for trans-coding between code excited linear prediction (CELP) codecs having different bandwidths in accordance with the present invention.

Referring to FIG. 3, an apparatus for trans-coding between CELP codecs having different bandwidths in accordance with the present invention includes a formant parameter translator 32, a formant parameter quantizer 34, an excitation parameter translator 36 and an excitation parameter quantizer 38.

The formant parameter translator 32 translates formant parameters encoded in an input CELP format into an output CELP format and generates formant parameters in the output CELP format.

The formant parameter quantizer 34 receives the translated formant parameters from the formant parameter translator 32 and quantizes the translated formant parameters in an output CELP format.

The excitation parameter translator 36 translates excitation parameters encoded in the input CELP format into the output CELP format and generates excitation parameters in the output CELP format.

The excitation parameter quantizer 38 receives the translated excitation parameters from the excitation parameter translator 36 and quantizes the translated excitation parameters in the output CELP format.

The formant parameter translator 32 includes type converters 320A to 302D, a formant bandwidth converter 321, a formant model order converter 322 and a formant frame rate converter 323.

The type converter 320A receives formant parameters from the input bit stream and converts formant parameters from the type specified in the input CELP format to a suitable type, e.g., line spectral frequency (LSF) for formant bandwidth conversion.

The formant bandwidth converter 321 receives the formant parameters from the type converter 320A and converts the formant parameters from a bandwidth of an input CELP format to a bandwidth of an output CELP format.

The type converter 320B receives the bandwidth-corrected formant parameters from the formant bandwidth converter 321 and converts the formant parameters from the type used in the formant bandwidth converter 321 to a suitable type, e.g., LPC, reflection coefficient (RC), or log area ratio (LAR) etc for model order conversion.

The formant model order converter 322 receives the input formant parameters from the type converter 320B and converts the formant parameters from the model order in the input CELP format into the model order in the output CELP format.

The type converter 320C receives the order-corrected formant parameters from the formant model order converter 322 and converts the formant parameters from the type used in the model order converter 322 to a suitable type, e.g., line spectral pair (LSP), or LSF etc for frame rate conversion.

The formant frame rate converter 323 receives the input formant parameters from the type converter 320C and converts the formant parameters from the frame rate in the input CELP format to the frame rate in the output CELP format.

This formant frame rate converter usually performs the operation on the inter-frame basis determined by the frame rate difference of two codecs.

The type converter 320D receives the frame rate-corrected formant parameters from the formant frame rate converter 323 and converts the formant parameters from the type used in frame rate converter 323 to a suitable type for the formant parameter quantizer 34 in the output CELP format.

The formant bandwidth converter 321 compresses the bandwidth of the formant parameters and generates the bandwidth-corrected formant parameters when the bandwidth of the input CELP format is wider than that of the output CELP format. The formant bandwidth converter 321 expands the bandwidth of the formant parameters and generates the bandwidth-corrected formant parameters when the bandwidth of the input CELP format is narrower than that of the output CELP format.

The formant model order converter 322 truncates the bandwidth-corrected formant parameters and generates the model order-corrected formant parameters when the model order of the bandwidth-corrected formant parameters is higher than that of the output CELP format. The formant model order converter 322 extends the bandwidth-corrected formant parameters and generates model order-corrected formant parameters when the model order of the bandwidth-corrected formant parameters is lower than that of the output CELP format.

The formant frame rate converter 323 decimates the order-corrected formant filter coefficients and generates the frame rate-corrected formant parameters when the frame rate of the order-corrected formant parameters is higher than that of the output CELP format. The formant frame rate converter 323 interpolates the order-corrected formant parameters and generates the frame rate-corrected formant parameters when the frame rate of the order-corrected formant parameters is lower than that of the output CELP format.

The formant parameter quantizer 34 receives the output formant parameters from the formant type converter 320D and quantizes the formant parameters in the output CELP format.

The excitation parameter translator 36 includes an excitation synthesizer 324, an excitation bandwidth converter 325, a type converter 320E, a formant coefficient interpolator 326, a type converter 320F, a perceptual weighting filter 327, an adaptive codebook searcher 328 and a fixed codebook searcher 329.

The excitation synthesizer 324 generates an excitation signal using input CELP format excitation parameters.

The excitation bandwidth converter 325 receives the synthesized excitation signal from the excitation synthesizer 324 and converts the excitation signal from the bandwidth of the input CELP format to the bandwidth of the output CELP format.

The type converter 320E receives the frame rate-corrected formant parameters from the formant frame rate converter 323 and converts the frame rate-corrected formant parameters from the type used in the frame rate converter 323 to a suitable type for formant coefficient interpolation.

The formant coefficient interpolator 326 receives the formant filter coefficients from the type converter 320E and generates the each formant filter coefficients set for sub-frame analysis.

The type converter 320F receives the formant filter coefficients of each sub-frame from the formant coefficient interpolator 326 and converts the formant filter coefficients of each sub-frame from the type used in the formant coefficient interpolator 326 to a suitable type for perceptual weighting filtering.

The perceptual weighting filter 327 receives the formant filter coefficients from the type converter 320F and constructs a corresponding perceptual weighting filter, then receives the excitation signal corresponding to each sub-frame from the excitation bandwidth converter 325, and performs filtering the excitation signal through the constructed perceptual weighting filter.

The adaptive codebook searcher 328 finds optimal pitch delay in the output CELP format for each sub-frame generally based on the conventional analysis-by-synthesis scheme using an adaptive codebook target signal, which is the output signal of the perceptual weighting filter 327 and then computes a accompanying gain of the adaptive codebook.

The fixed codebook searcher 329 finds the best model for the residual signal from the pre-defined codebook in the output CELP format for each sub-frame generally based on the conventional analysis-by-synthesis scheme using a signal produced by subtracting the contribution of the adaptive codebook from the adaptive codebook target signal and then computes an accompanying gain of the fixed codebook.

The excitation bandwidth converter 325 decimates the synthesized excitation signal from a sampling frequency of input CELP format to that of output CELP format and generates the bandwidth-converted excitation signal when a bandwidth of the input CELP format is wider than that of the output CELP format. This procedure can be done by the conventional decimation operation. The excitation bandwidth converter 325 interpolates the synthesized excitation signal from a sampling frequency of input CELP format to that of output CELP format and generates the bandwidth-converted excitation signal when the bandwidth of the input CELP format is narrower than that of the output CELP format. This procedure can be done by the conventional interpolation operation.

An excitation parameter quantizer 38 receives the excitation parameters, that is, adaptive codebook delay, adaptive codebook gain, fixed codebook and fixed codebook gain, from the adaptive codebook searcher 328 and the fixed codebook searcher 329 and quantizes the excitation parameters.

FIGS. 4 to 7 are flowcharts showing operating procedures of a formant parameter translator in accordance with the present invention.

The type converter 320A receives formant parameters and converts the formant parameters of each input speech packet from the type in the input CELP format to a suitable type for formant bandwidth conversion. The bandwidth is generally a half of a sampling frequency. The bandwidth conversion is necessary when two CELP codecs have different bandwidths, e.g., one has a bandwidth of 4 kHz and the other has a bandwidth of 8 kHz.

At step 402, the type converter 320A converts the input formant parameters into the line spectral frequency (LSF) in the preferred embodiment of the present invention. If the input formant parameters are in the LSF format, step 420 is unnecessary.

At step 404, the formant bandwidth converter 321 receives the LSF coefficients and converts the bandwidth of the LSF coefficients from the input CELP format to the output CELP format by LSF truncation or extrapolation.

Figure 5:
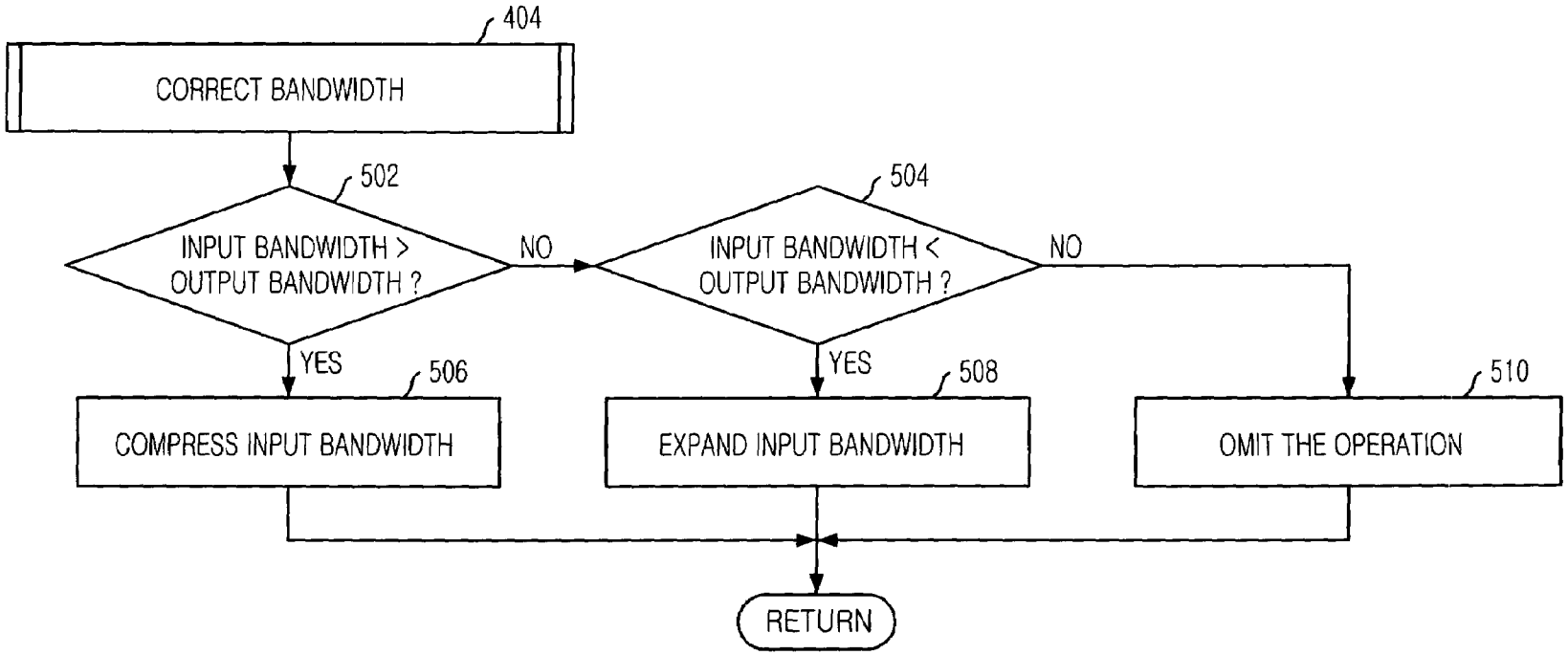

At step 506 in FIG. 5, the bandwidth of the LSF coefficients is compressed when the bandwidth of the input CELP format is wider than that of output CELP format at step 502. At step 508 in FIG. 5, the bandwidth of the LSF coefficients is expanded when the bandwidth of the input CELP format is narrower than that of output CELP format at step 504.

The formant bandwidth converter 321 truncates the input LSF coefficients out of the bandwidth span of the output CELP format in the bandwidth compression operation. The formant bandwidth converter 321 extrapolates the input LSF coefficients into the new LSF coefficients spanning the bandwidth of output CELP format in the bandwidth expansion operation.

At step 510, if the bandwidths of the input and output CELP formats are the same, the bandwidth conversion is unnecessary.

The type converter 320B receives the bandwidth-corrected formant parameters from the formant bandwidth converter 321 and converts the formant parameters from the type used in the formant bandwidth converter 321 to a suitable type for model order conversion.

At step 406, the formant type converter 320B converts the formant parameters from the type used in the formant bandwidth converter 321 to the reflection coefficients in the preferred embodiment of the present invention.

At step 408, the formant model order converter 322 receives the reflection coefficients and converts the model order of the reflection coefficients from the order of the input CELP format to the order of the output CELP format.

Figure 6:
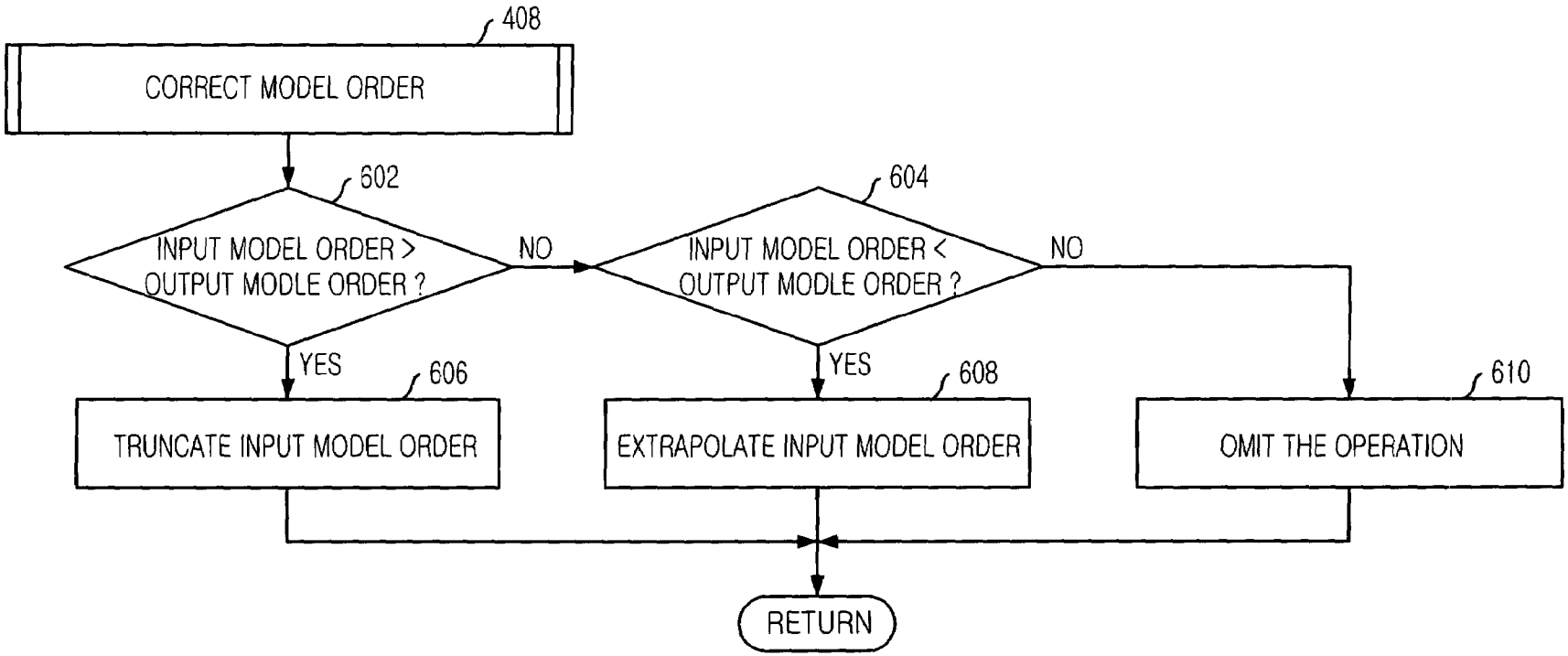

At step 606 in FIG. 6, the model order of the input format is reduced by truncating the input reflection coefficients when the model order of the input format is higher than that of output format at step 602.

At step 608 in FIG. 6, the model order of the input format is increased by extrapolating the input reflection coefficients when the model order of the input format is lower than that of output format at step 604.

Unnecessary coefficients over the model order of the output CELP format are deleted in the truncation procedure and zeros are padded to the input reflection coefficients in the extrapolation procedure.

At step 610, if the model order of the input CELP format is the same as the model order of the output CELP format, the model order conversion is unnecessary.

The type converter 320C receives the model order-corrected formant parameters from the formant model order converter 322 and converts the formant parameters from the type used in the formant model order converter 322 to a suitable type for frame rate conversion.

Frame rate is a number of frames per seconds and is related to analysis frame size of codec, i.e., frame rate is 1/(frame size). If two codecs for trans-coding use a different frame size, an appropriate frame rate compensation operation is needed. Generally, frame rate conversion for the formant parameters is done by interpolating the parameters on inter-frame.

At step 410, the formant type converter 320C converts the model order-corrected formant parameters from the type used in the formant model order converter 322 to the LSP coefficients in the preferred embodiment of the present invention. At step 412, the formant frame rate converter 323 receives the LSP coefficients and converts the frame rate of the coefficients from the LSP format to the output CELP format.

Figure 7:
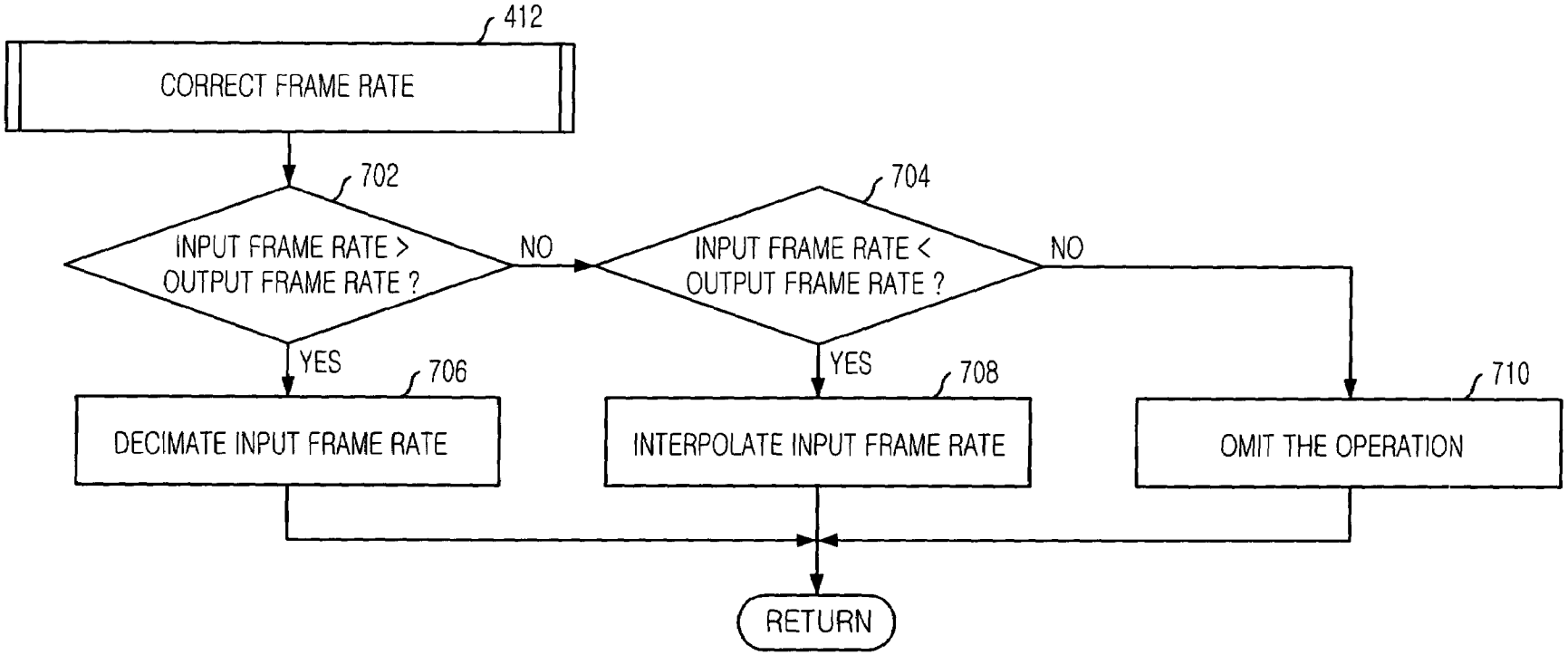

At step 706 in FIG. 7, the frame rate of the LSP coefficients is decimated to be matched to the frame rate of the output CELP format when the frame rate of the input format is higher than that of output format at step 702.

At step 708 in FIG. 7, the frame rate of the LSP coefficients is interpolated when the frame rate of the input format is lower than that of output format at step 704.

Both of frame rate decimation and frame rate interpolation are performed on inter-frame. That is, the new frame rate-converted LSF coefficients are obtained by weighting LSP coefficients at current frame and at past frames, and summing the results.

At step 710, if frame rates of the input and output formats are the same, the frame rate conversion is unnecessary.

At step 414, the type converter 320D receives the frame rate-corrected formant parameters in a LSP from the formant frame rate converter 323 and converts the formant parameters from the LSP to the type for the formant parameter quantizer 34.

At step 416, the formant parameter quantizer 34 receives the formant parameters from the formant type converter 320D and quantizes the formant parameters.

Figure 8:
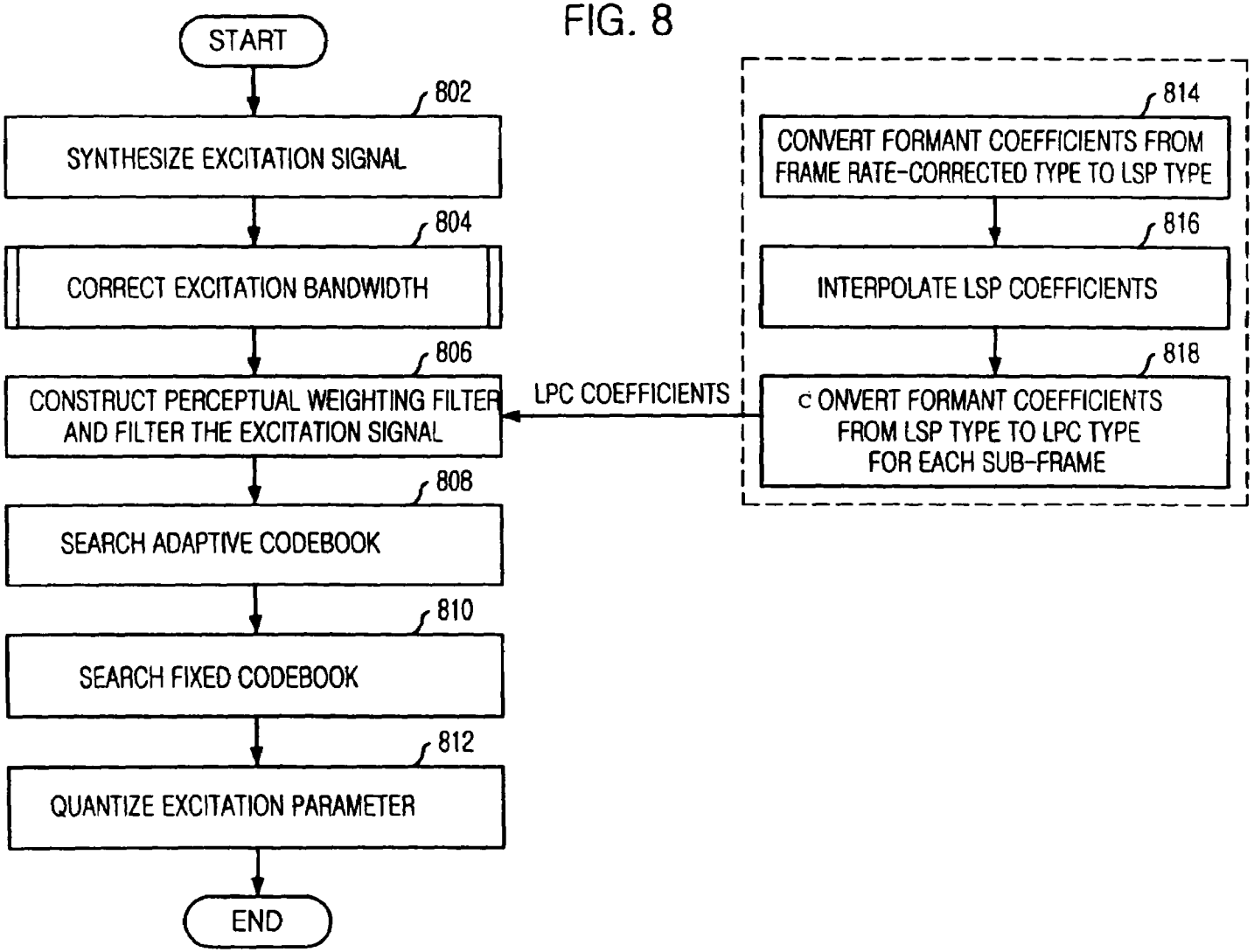
FIGS. 8 to 9 are flowcharts explaining operating procedures of an excitation parameter translator in accordance with the present invention.
Figure 9:
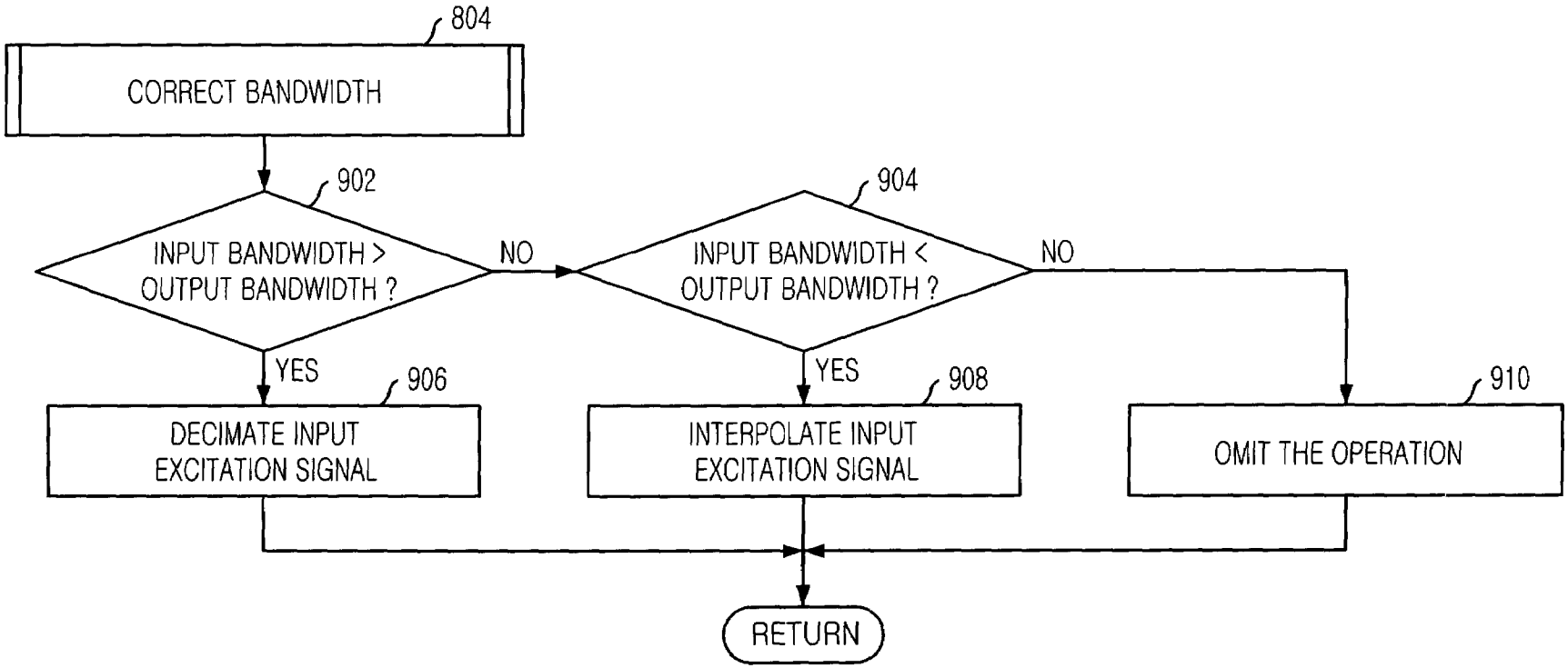

FIGS. 8 to 9 are flowcharts showing operating procedures of an excitation parameter translator in accordance with the present invention.

At step 802, the excitation synthesizer 324 generates an excitation signal by decoding the input CELP format excitation parameters. Generally, the excitation parameters include an adaptive codebook index, a fixed codebook index and gains of each codebook. The excitation synthesizer 324 generates an excitation signal using these excitation parameters. The generating operation of the excitation signal is the same to that used by CELP decoder.

At step 804, the excitation bandwidth converter 325 receives the synthesized excitation signal from the excitation synthesizer 324 and converts the excitation signal from the bandwidth of the input CELP format to the bandwidth of the output CELP format.

At step 906 in FIG. 9, the excitation signal is decimated from the sampling frequency of the input CELP format to the sampling rate of the output CELP format when the bandwidth of the input format is wider than that of output format at step 902. At step 908 in FIG. 9, the excitation signal is interpolated from the sampling frequency of the input CELP format to the sampling rate of the output CELP format when the bandwidth of the input format is narrower than that of output format at step 904.

At step 910, if bandwidths of the input and output formats are the same, the bandwidth conversion is unnecessary.

At the excitation bandwidth converter 325, the decimation procedure is composed of low pass filtering and down-sampling and the interpolation procedure is composed of up-sampling and low pass filtering in accordance with the present invention.

At step 814, the type converter 320E receives the frame rate-corrected formant parameters from the formant frame rate converter 323 and converts the frame rate-corrected formant parameters to LSP parameters for formant coefficient interpolation in the preferred embodiment of the present invention.

At step 816, the formant coefficient interpolator 326 receives the formant parameters from the type converter 320E and generates the formant filter coefficients for each sub-frame. The formant coefficient interpolator 326 interpolates the LSP by adequately weighting for each sub-frame similar to the formant frame rate converter 323.

At step 818, the type converter 320F receives the formant parameters of each sub-frame from the formant coefficient interpolator 326 and converts the formant parameters of each sub-frame from the LSP to a LPC suitable type for perceptual weighting filtering.

At step 806, the perceptual weighting filter 327 receives the formant parameters from the type converter 320F and constructs a perceptual weighting filter. Then, the perceptual weighting filter 327 receives the excitation signal of each sub-frame from the excitation bandwidth converter 325 and filters the excitation signal using the constructed perceptual weighting filter.

At step 808, the adaptive codebook searcher 328 finds pitch delay in the output CELP format for each sub-frame generally based on the conventional analysis-by-synthesis scheme using a adaptive codebook target signal, which is the output signal of the perceptual weighting filter 327 and computes a gain of the adaptive codebook.

At step 810, the fixed codebook searcher 329 finds the best model for the residual signal from the pre-defined codebook structure in the output CELP format for each sub-frame generally based on the conventional analysis-by-synthesis scheme using fixed codebook target signal produced by subtracting the contribution of the adaptive codebook from the adaptive codebook target signal and computes a gain of the fixed codebook.

At step 812, the excitation parameter quantizer 38 receives the excitation parameters from the adaptive codebook searcher 328 and the fixed codebook searcher 329 and quantizes the excitation parameters.

The present invention overcomes problems of tandem coding method such as degradation of speech quality, increased system latency and computations.

Also, the present invention can be used for trans-coding between narrowband network and wideband network.

The method of the present invention can be implemented as a program and stored in a computer readable medium, e.g., a CD-ROM, a RAM, a ROM, a Floppy Disk, a Hard Disk, and an Optical magnetic Disk.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for trans-coding between code excited linear prediction (CELP) type codecs having different bandwidths, comprising:

a first type converting means for receiving formant parameters from the input bit stream and converting formant parameters from the type specified in the input CELP format to a suitable type for formant bandwidth conversion;

a formant parameter translating means for translating formant parameters from input CELP format to output CELP format and generating translated formant parameters in an output CELP format, the formant parameter translating means to include a formant bandwidth converting means to generate bandwidth-corrected formant parameters, the formant parameter translating means further to include a formant frame rate converting means to generate frame rate-corrected formant parameters, wherein the formant bandwidth converting means receives the input formant parameters from the first type converting means and converts the formant parameters from a bandwidth of an input CELP format to a bandwidth of an output CELP format, the formant bandwidth converting means expands the bandwidth of the formant parameters by extrapolating input line spectral frequency (LSF) coefficients into new LSF coefficients that span the bandwidth of the output CELP format to generate the bandwidth-corrected formant parameters when the bandwidth of the input CELP format is narrower than that of the output CELP format, and the formant bandwidth converting means compresses the bandwidth of the formant parameters by truncating the input LSF coefficients from a bandwidth span of the output CELP format to generate the bandwidth-corrected formant parameters when the bandwidth of the input CELP format is wider than that of the output CELP format;

a formant parameter quantizing means for receiving the translated formant parameters and quantizing the translated formant parameters;

an excitation parameter translating means for translating excitation parameters from input CELP format to output CELP format and generating excitation parameters in an output CELP format, the excitation parameter translating means to receive the frame rate-corrected formant parameters from the formant frame rate converting means before the translated formant parameters are quantized by the formant parameter quantizing means, the excitation parameter translating means further to convert the frame rate-corrected formant parameters to generate converted parameters, to interpolate the converted parameters by weighing sub-frames to generate interpolated parameters, and to construct a perceptual weighing filter by using the interpolated parameters; and an excitation quantizing means for receiving the translated excitation parameters and quantizing the translated excitation parameters, wherein the excitation parameter translating means comprises:

an excitation synthesizing means to generate an excitation signal by using input CELP format excitation parameters; and an excitation bandwidth converting means to receive the excitation signal from the excitation synthesizing means, convert the excitation signal from the bandwidth of the input CELP format to the bandwidth of the output CELP format, and output the excitation signal having the bandwidth of the output CELP format to the perceptual weighing filter, wherein the excitation signal is decimated from a sampling frequency of the input CELP format to a sampling rate of the output CELP format when the bandwidth of the input CELP format is wider than that of the output CELP format, the excitation signal is interpolated from the sampling frequency of the input CELP format to the sampling rate of the output CELP format when the bandwidth of the input CELP format is narrower than that of the output CELP format.

2. The apparatus as recited in claim 1, wherein the formant parameter translating means further includes:

a second type converting means for receiving the bandwidth-corrected formant parameters from the formant bandwidth converting means and converting the formant parameters from the type used in the formant bandwidth converting means to a suitable type for model order conversion;

a formant model order converting means for receiving the input formant parameters from the second type convening means and converting the formant parameters from the model order in the input CELP format into the model order in the output CELP format;

a third type converting means for receiving the order-corrected formant parameters from the formant model order converting means and converting the formant parameters from the type used in the model order converting means to a suitable type for frame rate conversion;

the formant frame rate converting means for receiving the input formant parameters from the third type converting means and converting the formant parameters from the frame rate in the input CELP format to the frame rate in the output CELP format; and a fourth type converting means for receiving the frame rate-corrected formant parameters from the formant frame rate converting means and converting the formant parameters from the type used in the formant frame rate converting means to a suitable type for the formant parameter quantizing means in the output CELP format.

3. The apparatus as recited in claim 2, wherein the formant model order converting means truncates the bandwidth-corrected formant parameters and generates the model order-corrected formant parameters when the model order of the bandwidth-corrected formant parameters is higher than that of the output CELP format and extends the bandwidth-corrected formant parameters and generates model order-corrected formant parameters when the model order of the bandwidth-corrected formant parameters is lower than that of the output CELP format.

4. The apparatus as recited in claim 2, wherein the formant frame rate converting means decimates the order-corrected formant filter coefficients and generates the frame rate-corrected formant parameters when the frame rate of the order-corrected formant parameters is higher than that of the output CELP format and interpolates the order-corrected formant parameters and generates the frame rate-corrected formant parameters when the frame rate of the order-corrected formant parameters is lower than that of the output CELP format.

5. The apparatus as recited in claim 2, wherein the excitation parameter translating means includes:

a fifth type converting means for receiving the frame rate-corrected formant parameters from the formant frame rate converting means and converting the frame rate-corrected formant parameters from the type used in the frame rate converting means to a suitable type for formant coefficient interpolation;

a formant coefficient interpolating means for receiving the formant filter coefficients from the fifth type convening means and generating each of the formant filter sets for sub-frame analysis;

a sixth type convening means for receiving the formant filter coefficients of each sub-frame from the formant coefficient interpolating means and convening the formant filter coefficients of each sub-frame from the type used in the formant coefficient interpolating means to a suitable type for perceptual weighting filtering;

the perceptual weighting filtering means for receiving the formant filter coefficients from the sixth type converting means and constructs the corresponding perceptual weighting filter, then receiving the excitation signal corresponding to each sub-frame from the excitation bandwidth converting means, and performing filtering the excitation signal through the constructed perceptual weighting filter;

an adaptive codebook searching means for finding optimal pitch delay in the output CELP format for each sub-frame generally based on the conventional analysis-by-synthesis scheme using an adaptive codebook target signal, which is the output signal of the perceptual weighting filtering means and then computing an accompanying gain of the adaptive codebook; and a fixed codebook searching means for finding the best model for the residual signal from the pre-defined codebook in the output CELP format for each sub-frame generally based on the conventional analysis-by-synthesis scheme using a signal produced by subtracting the contribution of the adaptive codebook from the adaptive codebook target signal and then computing an accompanying gain of the fixed codebook.

6. A method for trans-coding between CELP type codecs having different bandwidths, comprising the steps of:

a) translating formant parameters from input CELP format to output CELP format and generating translated formant parameters in an output CELP format, wherein translating the formant parameter includes expanding the bandwidth of the formant parameters by extrapolating input line spectral frequency (LSF) coefficients into new LSF coefficients that span the bandwidth of the output CELP format to generate bandwidth-corrected formant parameters when the bandwidth of the input CELP format is narrower than that of the output CELP format, and compressing the bandwidth of the formant parameters by truncating the input LSF coefficients from a bandwidth span of the output CELP format to generate the bandwidth-corrected formant parameters when the bandwidth of the input CELP format is wider than that of the output CELP format, wherein translating the formant parameter further includes:

converting the formant parameters from a frame rate in the input CELP format to another frame rate in the output CELP format to generate frame rate-corrected formant parameters;

b) receiving the translated formant parameters and quantizing the translated formant parameters;

c) translating excitation parameters from input CELP format to output CELP format and generating excitation parameters in an output CELP format, wherein translating excitation parameters further comprises:

receiving the frame rate-corrected formant parameters before the translated formant parameters are quantized;

converting the frame rate-corrected formant parameters to generate converted parameters;

interpolating the converted parameters by weighing sub-frames to generate interpolated parameters; and constructing a perceptual weighing filter by using the interpolated parameters;

generating an excitation signal by using input CELP format excitation parameters;

converting the excitation signal from the bandwidth of the input CELP format to the bandwidth of the output CELP format, and outputting the excitation signal having the bandwidth of the output CELP format to the perceptual weighing filter, wherein the excitation signal is decimated from a sampling frequency of the input CELP format to a sampling rate of the output CELP format when the bandwidth of the input CELP format is wider than that of the output CELP format, the excitation signal is interpolated from the sampling frequency of the input CELP format to the sampling rate of the output CELP format when the bandwidth of the input CELP format is narrower than that of the output CELP format; and d) receiving the translated excitation parameters and quantizing the translated excitation parameters, the excitation bandwidth converting means decimates the synthesized excitation signal from a sampling frequency of input CELP format to that of output CELP format and generates the bandwidth-converted excitation signal when a bandwidth of the input CELP format is wider than that of the output CELP format, and interpolates the synthesized excitation signal from a sampling frequency of input CELP format to that of output CELP format and generates the bandwidth-converted excitation signal when the bandwidth of the input CELP format is narrower than that of the output CELP format.

7. A computer readable recording medium for executing a method of trans-coding between CELP type codecs having different bandwidths, comprising the functions of:

a) translating formant parameters from input CELP format to output CELP format and generating translated formant parameters in an output CELP format, wherein translating the formant parameter includes expanding the bandwidth of the formant parameters by extrapolating input line spectral frequency (LSF) coefficients into new LSF coefficients that span the bandwidth of the output CELP format to generate the bandwidth-corrected formant parameters when the bandwidth of the input CELP format is narrower than that of the output CELP format, and compressing the bandwidth of the formant parameters by truncating the input LSF coefficients from a bandwidth span of the output CELP format to generate the bandwidth-corrected-formant parameters when the bandwidth of the input CELP format is wider than that of the output CELP format, wherein translating the formant parameter further includes:

converting the formant parameters from a frame rate in the input CELP format to another frame rate in the output CELP format to generate frame rate-corrected formant parameters;

b) receiving the translated formant parameters and quantizing the translated formant parameters;

c) translating excitation parameters from input CELP format to output CELP format and generating excitation parameters in an output CELP format, wherein translating excitation parameters further comprises:

receiving the frame rate-corrected formant parameters before the translated formant parameters are quantized;

converting the frame rate-corrected formant parameters to generate converted parameters;

interpolating the converted parameters by weighing subframes to generate interpolated parameters; and constructing a perceptual weighing filter by using the interpolated parameters;

generating an excitation signal by using input CELP format excitation parameters;

converting the excitation signal from the bandwidth of the input CELP format to the bandwidth of the output CELP format, and outputting the excitation signal having the bandwidth of the output CELP format to the perceptual weighing filter, wherein the excitation signal is decimated from a sampling frequency of the input CELP format to a sampling rate of the output CELP format when the bandwidth of the input CELP format is wider than that of the output CELP format, the excitation signal is interpolated from the sampling frequency of the input CELP format to the sampling rate of the output CELP format when the bandwidth of the input CELP format is narrower than that of the output CELP format; and d) receiving the translated excitation parameters and quantizing the translated excitation parameters.

* * * * *